US011492185B2

(12) United States Patent
Zammit et al.

(10) Patent No.: US 11,492,185 B2
(45) Date of Patent: Nov. 8, 2022

(54) HANDLED CARRIER FOR CONTAINERS

(71) Applicant: Graphic Packaging International, LLC, Atlanta, GA (US)

(72) Inventors: Mark Zammit, Douglasville, GA (US); Kevin T. May, Kennesaw, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

(21) Appl. No.: 17/193,389

(22) Filed: Mar. 5, 2021

(65) Prior Publication Data

US 2021/0276776 A1 Sep. 9, 2021

Related U.S. Application Data

(60) Provisional application No. 62/985,997, filed on Mar. 6, 2020.

(51) Int. Cl.
*B65D 71/44* (2006.01)
*B65B 17/02* (2006.01)

(52) U.S. Cl.
CPC ..... *B65D 71/44* (2013.01); *B65B 17/025* (2013.01)

(58) Field of Classification Search
CPC ..... B65B 17/025; B65D 71/30; B65D 71/44; B65D 71/48
USPC ..... 206/141; 294/87.2
See application file for complete search history.

(56) References Cited

U.S. PATENT DOCUMENTS 1,527,399 A 2/1925 Davidson
2,289,859 A 7/1942 Arthur
2,299,625 A * 10/1942 Holmes ..... B65D 71/44 294/87.2
2,375,631 A 5/1945 Villard
2,397,716 A * 4/1946 Wendler ..... B65D 71/40 206/148
2,522,950 A 9/1950 Keith
2,563,065 A 8/1951 Price
2,603,923 A * 7/1952 Chidsey, Jr. ..... B65D 71/30 53/413

(Continued)

FOREIGN PATENT DOCUMENTS

EP 0 060 504 A2 9/1982
GB 2163949 A * 3/1986 ..... B65D 71/48

(Continued)

OTHER PUBLICATIONS

International Search Report and Written Opinion for PCT/US2021/021069 dated Jun. 25, 2021.

*Primary Examiner* — Bryon P Gehman
(74) *Attorney, Agent, or Firm* — Womble Bond Dickinson (US) LLP

(57) ABSTRACT

A carrier for holding a plurality of containers includes a plurality of panels having at least one attachment panel configured to receive a portion of one or more containers of the plurality of containers, at least one top panel, and at least one handle panel foldably connected to the at least one top panel. The carrier also includes a handle formed from the at least one handle panel, the handle is positionable between a first position wherein the at least one handle panel is generally parallel to the at least one top panel, and a second position in which the at least one handle panel is folded relative to the at least one top panel and is positioned for grasping and carrying of the carrier.

45 Claims, 5 Drawing Sheets

(56) References Cited

U.S. PATENT DOCUMENTS

| | | | | |
|---|---|---|---|---|
| 2,798,603 | A | 7/1957 | Grinspoon | |
| 2,802,597 | A | 8/1957 | Davis | |
| 2,874,870 | A * | 2/1959 | Collura | B65D 71/30 229/117.14 |
| 2,950,041 | A | 8/1960 | Stone | |
| 3,073,644 | A | 1/1963 | Baker et al. | |
| 3,107,811 | A | 10/1963 | Lemon | |
| 3,528,697 | A | 9/1970 | Wood | |
| 3,661,417 | A * | 5/1972 | Inman | B65D 71/48 294/87.2 |
| 3,684,153 | A | 8/1972 | Detzel | |
| 3,815,732 | A | 6/1974 | Klygis et al. | |
| 3,897,873 | A | 8/1975 | Graser | |
| 3,942,631 | A | 3/1976 | Sutherland et al. | |
| 4,304,329 | A | 12/1981 | Graser | |
| 4,372,599 | A | 2/1983 | Kiedaisch et al. | |
| 4,378,879 | A | 4/1983 | Killy | |
| 4,403,690 | A | 9/1983 | Fischer | |
| 4,470,503 | A | 9/1984 | Stone | |
| 4,518,115 | A | 5/1985 | Sedwick | |
| 5,139,147 | A | 8/1992 | Sutherland | |
| 5,267,644 | A | 12/1993 | Tsao | |
| 5,297,673 | A | 3/1994 | Sutherland | |
| 5,310,050 | A | 5/1994 | Sutherland | |
| 5,310,051 | A | 5/1994 | Sutherland | |
| 5,323,895 | A | 6/1994 | Sutherland et al. | |
| 5,328,024 | A | 7/1994 | Sutherland | |
| 5,351,815 | A | 10/1994 | Fogle et al. | |
| 5,351,816 | A | 10/1994 | Sutherland et al. | |
| 5,351,817 | A | 10/1994 | Sutherland | |
| 5,355,999 | A | 10/1994 | Sutherland | |
| 5,360,104 | A | 11/1994 | Sutherland | |
| 5,390,784 | A | 2/1995 | Sutherland | |
| 5,400,901 | A | 3/1995 | Harrelson | |
| 5,407,065 | A | 4/1995 | Sutherland | |
| 5,415,278 | A | 5/1995 | Sutherland | |
| 5,443,153 | A | 8/1995 | Sutherland | |
| 5,445,262 | A | 8/1995 | Sutherland | |
| 5,452,799 | A | 9/1995 | Sutherland | |
| 5,503,267 | A | 4/1996 | Sutherland | |
| 5,520,283 | A | 5/1996 | Sutherland | |
| 5,524,756 | A | 6/1996 | Sutherland | |
| 5,526,925 | A * | 6/1996 | Bernstein | B65D 71/44 294/87.2 |
| 5,551,566 | A | 9/1996 | Sutherland | |
| 5,593,027 | A | 1/1997 | Sutherland | |
| 5,624,024 | A | 4/1997 | Miess | |
| 5,746,310 | A | 5/1998 | Slomski | |
| 5,816,391 | A | 10/1998 | Harris | |
| 5,960,945 | A | 10/1999 | Sutherland | |
| 5,975,287 | A | 11/1999 | Negelen | |
| 6,059,099 | A | 5/2000 | Galbierz | |
| 6,082,532 | A * | 7/2000 | Miess | B65D 71/44 206/199 |
| 6,315,111 | B1 | 11/2001 | Sutherland | |
| 6,695,137 | B2 | 2/2004 | Jones et al. | |
| 6,896,130 | B2 | 5/2005 | Theelen | |
| 7,011,209 | B2 | 3/2006 | Sutherland et al. | |
| 7,748,603 | B2 | 7/2010 | Fogle et al. | |
| 7,823,721 | B2 | 11/2010 | Sutherland et al. | |
| 8,936,149 | B2 | 1/2015 | Smalley | |
| 9,199,774 | B2 | 12/2015 | Smalley et al. | |
| 9,415,914 | B2 | 8/2016 | Holley, Jr. | |
| 11,027,904 | B2 | 6/2021 | McCree et al. | |
| 2002/0195371 | A1 | 12/2002 | Brown | |
| 2003/0080004 | A1 | 5/2003 | Olsen et al. | |
| 2003/0213705 | A1 | 11/2003 | Woog | |
| 2005/0127151 | A1 | 6/2005 | Johnson | |

FOREIGN PATENT DOCUMENTS

| | | |
|---|---|---|
| JP | 07-309327 A | 11/1995 |
| JP | 2003-146359 | 5/2003 |
| WO | WO 93/22216 A1 | 11/1993 |

* cited by examiner

HANDLED CARRIER FOR CONTAINERS

CROSS-REFERENCE TO RELATED APPLICATION

This application claims the benefit of U.S. Provisional Patent Application No. 62/985,997, filed on Mar. 6, 2020.

INCORPORATION BY REFERENCE

The disclosures of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, U.S. Provisional Patent Application No. 62/841,449, filed on May 1, 2019, U.S. patent application Ser. No. 16/426,050, filed on May 30, 2019, U.S. patent application Ser. No. 16/426,057, filed on May 30, 2019, U.S. patent application Ser. No. 16/426,060, filed on May 30, 2019, U.S. patent application Ser. No. 16/426,063, filed on May 30, 2019, U.S. patent application Ser. No. 16/426,066, filed on May 30, 2019, U.S. Design patent application Ser. No. 29/692,992, filed on May 30, 2019, U.S. Design patent application Ser. No. 29/692,993, filed on May 30, 2019, U.S. Design patent application Ser. No. 29/692,994, filed on May 30, 2019, U.S. Design patent application Ser. No. 29/692,996, filed on May 30, 2019, U.S. Design patent application Ser. No. 29/692,997, filed on May 30, 2019, U.S. patent application Ser. No. 16/598,282, filed on Oct. 10, 2019, U.S. Design patent application Ser. No. 29/709,918, filed on Oct. 18, 2019, U.S. Provisional Patent Application No. 62/952,839, filed on Dec. 23, 2019, U.S. Provisional Patent Application No. 62/956,882, filed on Jan. 3, 2020, U.S. Provisional Patent Application No. 62/985,997, filed on Mar. 6, 2020, U.S. patent application Ser. No. 16/829,346, filed on Mar. 25, 2020, and U.S. Provisional Patent Application No. 63/015,898, filed on Apr. 27, 2020, U.S. Provisional Patent Application No. 63/022,757, filed on May 11, 2020, U.S. Provisional Patent Application No. 63/023,442, filed on May 12, 2020, U.S. Design patent application Ser. No. 29/735,178, filed on May 19, 2020, U.S. Provisional Patent Application No. 63/031,615, filed on May 29, 2020, U.S. Design patent application Ser. No. 29/739,927, filed on Jun. 30, 2020, U.S. Design patent application Ser. No. 29/739,929, filed on Jun. 30, 2020, U.S. Design patent application Ser. No. 29/739,931, filed on Jun. 30, 2020, U.S. Design patent application Ser. No. 29/739,933, filed on Jun. 30, 2020, U.S. Design patent application Ser. No. 29/739,934, filed on Jun. 30, 2020, U.S. Provisional Patent Application No. 63/085,365, filed on Sep. 30, 2020, U.S. Provisional Patent Application No. 63/086,681, filed on Oct. 2, 2020, and U.S. Provisional Patent Application No. 63/120,863, filed on Dec. 3, 2020, U.S. Provisional Patent Application No. 63/136,400, filed on Jan. 12, 2021, are hereby incorporated by reference for all purposes as if presented herein in their entirety.

BACKGROUND OF THE DISCLOSURE

The present disclosure generally relates to cartons or carriers for holding, displaying, and/or transporting containers.

SUMMARY OF THE DISCLOSURE

According to one aspect of the disclosure, a carrier for holding a plurality of containers comprises a plurality of panels comprising at least one attachment panel configured to receive a portion of one or more containers of the plurality of containers, at least one top panel, and at least one handle panel foldably connected to the at least one top panel, and a handle formed from the at least one handle panel, the handle is positionable between a first position wherein the at least one handle panel is generally parallel to the at least one top panel, and a second position in which the at least one handle panel is folded relative to the at least one top panel and is positioned for grasping and carrying of the carrier.

According to another aspect of the disclosure, a blank for forming a carrier for holding a plurality of containers comprises a plurality of panels comprising at least one attachment panel configured to receive a portion of one or more containers of the plurality of containers when the carrier is formed from the blank, at least one top panel, and at least one handle panel foldably connected to the at least one top panel. The at least one handle panel is for forming a handle when the carrier is formed from the blank, the handle for being positionable between a first position wherein the at least one handle panel is generally parallel to the at least one top panel, and a second position in which the at least one handle panel is folded relative to the at least one top panel and is positioned for grasping and carrying of the carrier formed from the blank.

According to another aspect of the disclosure, a method of forming a carrier for holding a plurality of containers comprises obtaining a blank comprising a plurality of panels including at least one attachment panel, at least one top panel, and at least one handle panel foldably connected to the at least one top panel, receiving at least one container of the plurality of containers in the at least one attachment panel, and folding the plurality of panels to form the carrier. The folding the plurality of panels comprises forming a handle from the at least one handle panel. The handle is positionable between a first position in which the at least one handle panel is generally parallel to the at least one top panel, and a second position in which the at least one handle panel is folded relative to the at least one top panel and is positioned for grasping and carrying of the carrier.

According to another aspect of the disclosure, a package comprises a plurality of containers and a carrier holding the plurality of containers. The carrier comprises a plurality of panels comprising at least one attachment panel configured receive a portion of respective containers of the plurality of containers, at least one top panel, and at least one handle panel foldably connected to the at least one top panel. The carrier further comprises a handle formed from the at least one handle panel, the handle is positionable between a first position wherein the at least one handle panel is generally parallel to the at least one top panel, and a second position in which the at least one handle panel is folded relative to the at least one top panel and is positioned for grasping and carrying of the carrier.

According to another aspect of the disclosure, a method of forming a package holding a plurality of containers is disclosed.

BRIEF DESCRIPTION OF THE DRAWINGS

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to carriers, packages, constructs, sleeves, cartons, or the like, for holding and displaying containers such as jars, bottles, cans, etc. The containers can be used for packaging food and beverage products, for example, beer, soft drinks, soups, beans, corn, vegetables, meat products, etc. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes food or beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
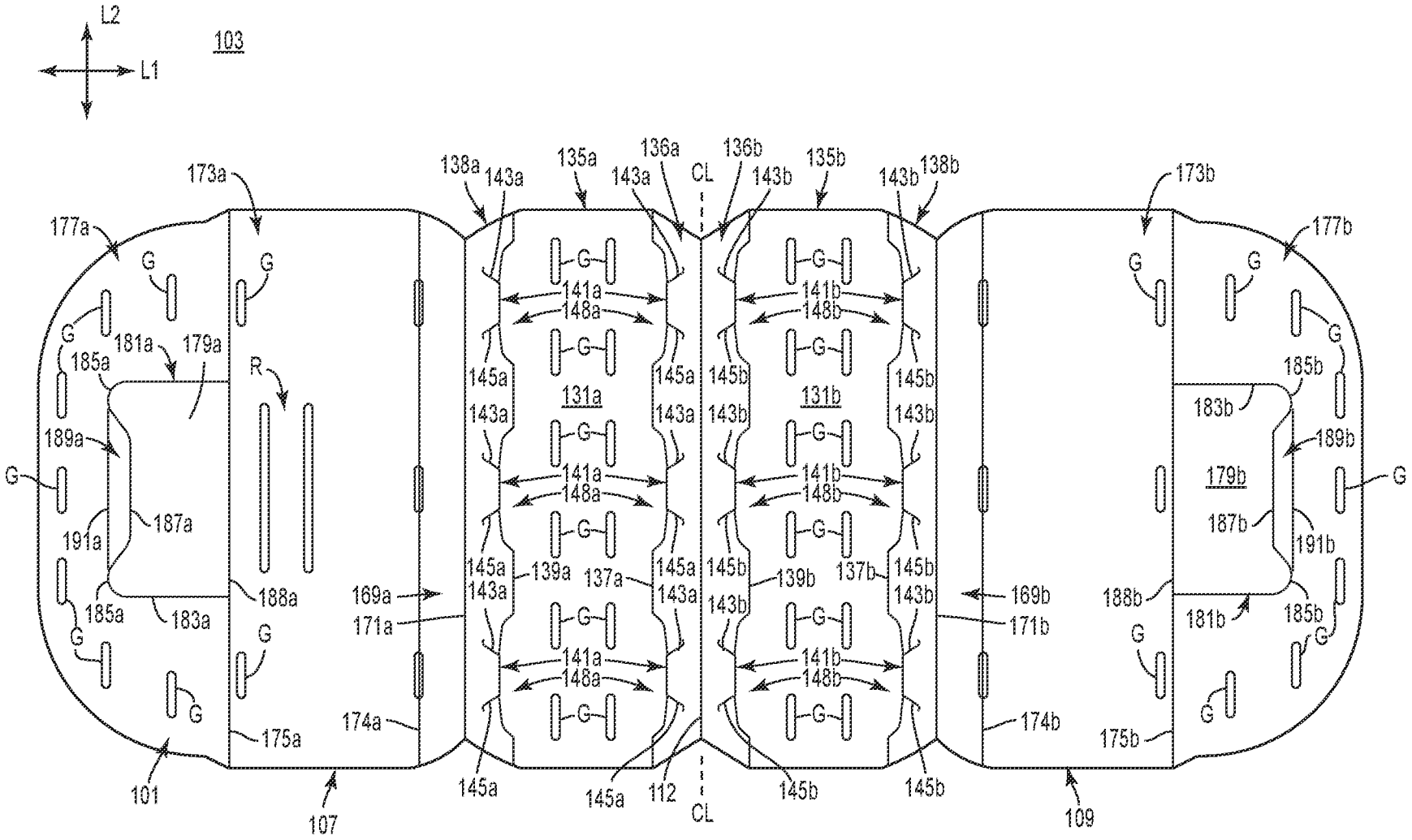
FIG. 1 is a plan view of an outer surface of a blank for forming a carrier and package according to a first exemplary embodiment of the disclosure.
Figure 2:
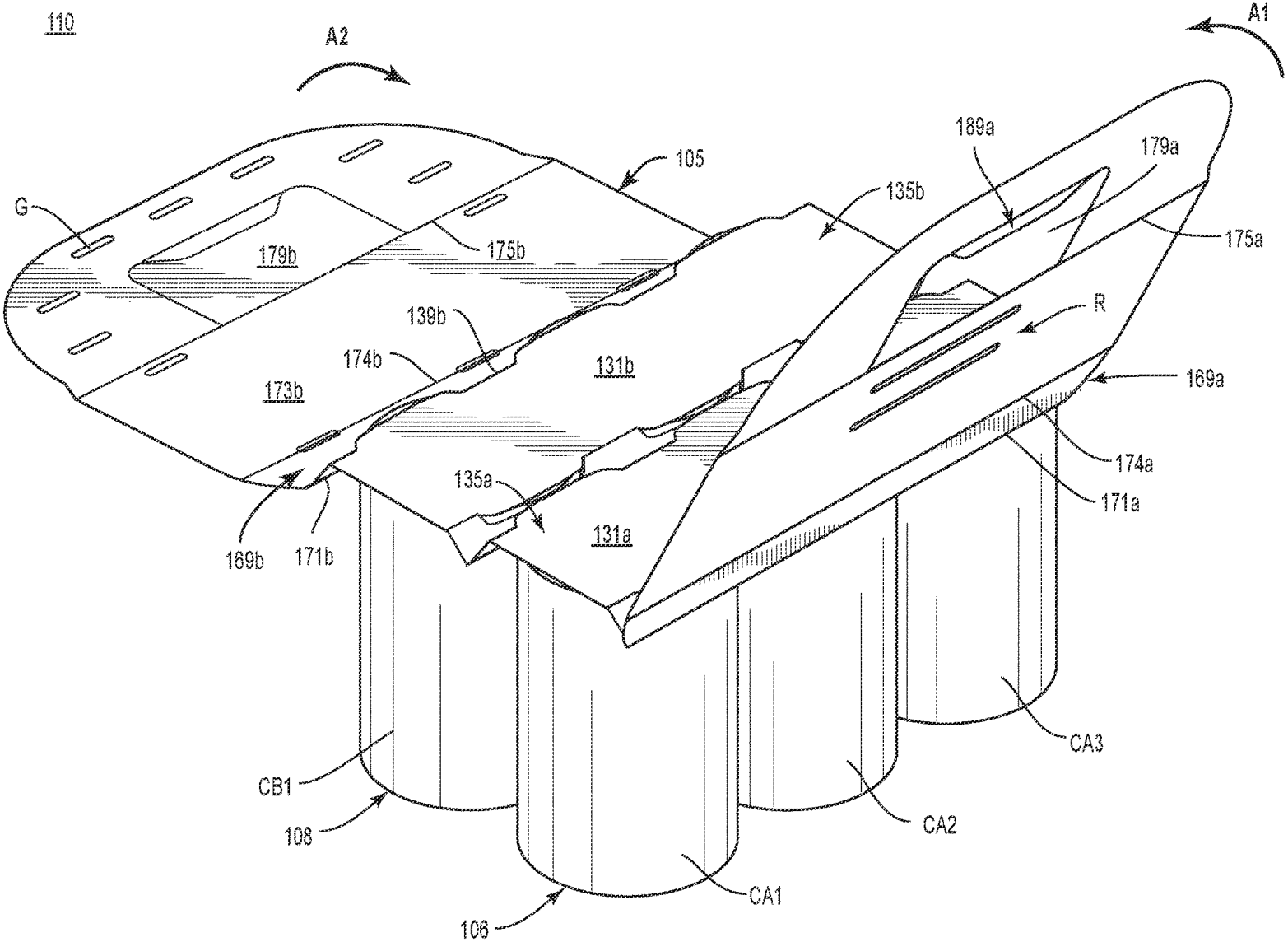
FIG. 2 is a perspective view of a partially folded configuration of a carrier formed from the blank of FIG. 1 and having a handle in an upright position according to the first exemplary embodiment.

FIG. 1 shows a plan view of an exterior side 101 of a blank 103 used to form a carrier 105 (FIG. 4) in accordance with a first exemplary embodiment of the disclosure. The carrier 105 can be sized to contain or support six containers, with three containers CA1, CA2, CA3 being attached to a front portion 106 of the carrier 105 and three containers CB1, CB2, CB3 being attached to a back portion 108 of the carrier 105.

Figure 4:
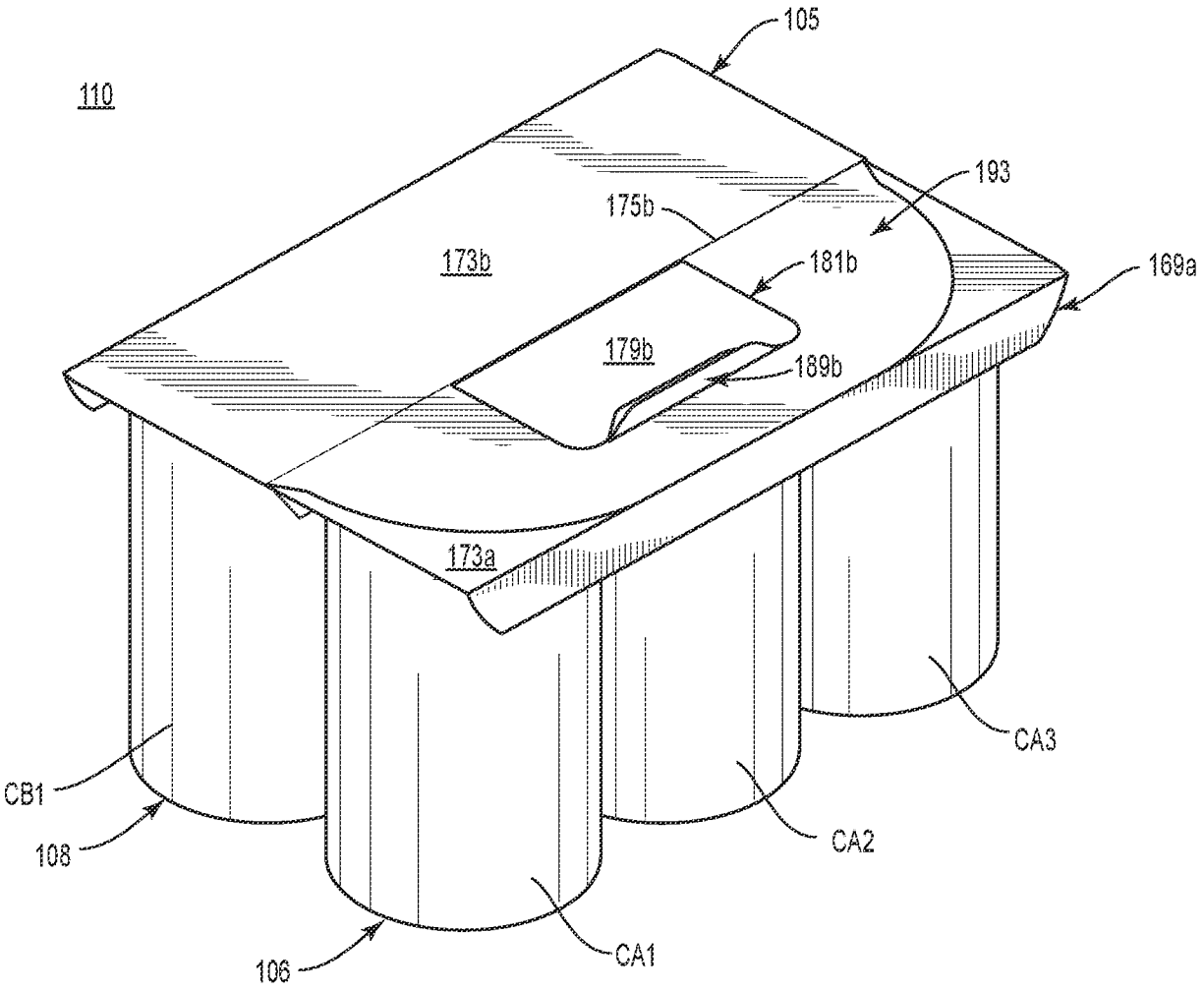
FIG. 4 is a perspective view of the carrier of FIG. 2 with a handle in a first position.

In the illustrated embodiment, the containers CA1, CA2, CA3, CB1, CB2, CB3 can be beverage cans, or could be any other suitable type and size of container (e.g., cans of stew, soup, chili, other canned food item, etc.) without departing from the disclosure. The carrier 105 can be sized and shaped to hold more or less than six containers. In one embodiment, the front portion 106 and the back portion 108 of the carrier 105 each have three containers, and in other embodiments, the front portion 106 and the back portion 108 of the carrier 105 can carry more or less than three containers without departing from the disclosure. The carrier 105 can be provided together with one or more containers as a package 110 (FIG. 4).

As shown in FIG. 1, the blank 103 has a longitudinal axis L1 and a lateral axis L2. The blank 103 has a front portion 107 for forming the front portion 106 of the carrier 105, and a back portion 109 for forming the back portion 108 of the carrier 105. The front portion 107 and the back portion 109 of the blank 103 are foldably connected at a lateral fold line 112 that forms a lateral centerline CL of the blank 103, as shown. As discussed further below, the blank 103 is at least partially formed into the carrier 105 by folding the blank 103 at the fold line 112 along the centerline CL so that the front portion 107 and the back portion 109 of the blank 103 are overlapped in at least partial face-to-face contact.

In the illustrated embodiment, a front container retention panel or front attachment panel 131*a* includes a container retention portion 135*a* that is at least partially defined between a pair of longitudinally-spaced lateral fold lines 137*a*, 139*a* that are each interrupted by respective pairs of longitudinally-spaced cuts 141*a* that can each include one or more curved and/or angled portions. As described further herein, the front attachment panel 131*a* is for receiving respective containers when the carrier 105 is formed from the blank 103. As shown, the longitudinally-spaced cuts 141*a* define container retention tabs 148*a* that extend outwardly from the container retention portion 135*a*. As also shown, respective oblique cuts 143*a*, 145*a* extend outwardly from each respective cut 141*a* to define a plurality of reconfigurable edges of the front attachment panel 131*a* that face the respective container retention tabs 148*a*.

As shown, an interior marginal portion 136*a* of the attachment panel 131*a* is defined between the fold lines 137*a*, 112, and an exterior marginal portion 138*a* of the attachment panel 131*a* is defined between the fold line 139*a* and a lateral fold line 171*a*.

The blank 103 additionally includes a bevel or front side panel 169*a* that is foldably connected to the front attachment panel 131*a* at the lateral fold line 171*a*, and a front top panel 173*a* that is foldably connected to the front side panel 169*a* at a lateral fold line 174*a*.

As shown the front top panel 173*a* can include a region R of adhesive, such as glue G, along a portion thereof to facilitate formation of the carrier 105 from the blank 103, as described further herein. The region of adhesive R can be a covered area on the top panel 173*a*, or can be provided in a patterned arrangement, for example, dots, lines, rings, patches, etc.

Still referring to FIG. 1, a front handle panel 177*a* can be foldably connected to the top panel 173*a* at the lateral fold line 175*a*, and includes a front handle opening/cutout 179*a* at least partially defined by a cut 181*a*. The cut 181*a*, as shown, can include a pair of longitudinal portions 183*a* that intersect respective curved portions 185*a* that intersect the respective endpoints of a generally lateral upper section 187*a* of the cut 181*a*. The upper section 187*a*, as shown, is disposed opposite a generally lateral lower section 188*a* that interrupts the fold line 175*a* and that extends from an endpoint of one longitudinal portion 183*a* of the cut 181*a* to an endpoint of the other longitudinal portion 183*a*. As also shown, a handle reinforcement tab 189*a* can be foldably connected to the handle panel 177*a* at a lateral fold line 191*a*.

In the illustrated embodiment, the back portion 109 of the blank 103 includes a back container retention panel or back attachment panel 131*b*, back side panel 169*b*, a back top panel 173*b*, and a back handle panel 177*b*, each having associated features that are generally a mirror-image of the corresponding panels and flaps of the front portion 107 of the blank 103. Corresponding components (e.g., panels, flaps, fold lines, cuts, etc.) have been designated by corresponding reference numbers that differ by the "a" or "b" suffix, with the "a" components corresponding to the front portion 107 of the blank 103 and the "b" components corresponding to the back portion 109 of the blank 103.

In contrast with the front portion 107 of the blank 103, the handle panel 177*b* of the back portion 109 of the blank 103 can include an access flap 179*b* defined by the cut/line of weakening 181*b*, instead of an opening/cutout. In this regard, the access flap 179*b* is separable from the surrounding portions of the handle panel 177*b*, the handle reinforcement tab 189*b*, and the back attachment panel 173*b* at respective portions of the cut/line of weakening 181*b*. As described further herein, the back access flap 179*b* is for being aligned with the handle opening 179*a* when the carrier 105 is formed from the blank 103.

Any of the panels, flaps, fold lines, cuts, or other features could be otherwise shaped, arranged, and/or omitted from the blank 103 without departing from the disclosure. The blank 103 could be sized and/or shaped to accommodate more or less than four containers without departing from this disclosure.

According to one exemplary embodiment of the disclosure, formation of the carrier 105 from the blank 103 can proceed by placing the exterior surface 101 of the blank 103 atop the containers CA1, CA2, CA3, CB1, CB2, CB3 such that the container retention portion 135*a* of the front attachment panel 131*a* overlies the containers CA1, CA2, CA3 and such that the container retention portion 135*b* of the back attachment panel 131*b* overlies the containers CB1, CB2, CB3. Further downward positioning of the attachment panels 131*a*, 131*b* over the plurality of containers CA1, CA2, CB3, CB1, CB2, CB3 can activate the respective container retention portions 135*a*, 135*b* to engage respective containers. For example, as the front attachment panel 131*a* is lowered or urged downwardly onto the containers CA1, CA2, CA3, the container retention portion 135*a* can at least partially separate from the remainder of the front attachment panel 131*a* at the cuts 141*a*. In such an arrangement, upper or top portions of the respective containers CA1, CA2, CA3 can extend at least partially through respective openings formed by the respective cuts 141*a* such that the container retention tabs 148*a* can engage, for example, a recessed portion of a rim or other top structure of the respective container CA1, CA2, CA3, and such that a plurality of reconfigurable edges of the marginal portions 136, 138*a* can engage, for example, a rolled rim edge or other top structure of the respective container CA1, CA2, CA3.

Such reconfiguration of the corresponding portions of the back attachment panel 131*b* can occur as the back attachment panel 131*b* is lowed or urged downwardly onto the containers CB1, CB2, CB3. During the above-described engagement of the respective container retention portions 135*a*, 135*b* with the respective containers, the marginal portions 136*a*, 138*a* of the attachment panel 131*a* can fold at least partially downwardly at the respective fold lines 137*a*, 139*a* in such a configuration, and, similarly, the marginal portions 136*b*, 138*b* of the attachment panel 131*b* can fold at least partially downwardly at the respective fold lines 137*b*, 139*b*.

Once the attachment panels 131*a*, 131*b* are engaged with the containers CA1, CA2, CA3, CB1, CB2, CB3 as described above, the front side panel 169*a* and the back side panel 169*b* can be folded upwardly at the respective fold lines 171*a*, 171*b* in the general direction of the respective arrows A1, A2. Simultaneously or thereafter, the top panels 173*a*, 173*b* can be folded at the respective fold lines 174*a*, 174*b* in the general direction of the respective arrows A1, A2 into at least partial face-to-face contact with the respective attachment panels 131*a*, 131*b*, e.g., the raised container-retention portions 135*a*, 135*b* of the respective attachment panels 131*a*, 131*b*.

The aforementioned folding of the attachment panels 131*a*, 131*b* can cause the respective handle panels 177*a*, 177*b* so as to be positioned in at least partial face-to-face contact to form a handle 193. The handle 193 is illustrated in FIG. 3 in a generally upright arrangement relative to the top panels 173*a*, 173*b*, e.g., such that the handle 193 is disposed in a perpendicular or obliquely-disposed arrangement relative to the top panels 173*a*, 173*b*.

In the illustrated embodiment, glue G can be provided on one or more portions of the blank 103/carrier 105 to maintain a desired arrangement thereof. As shown in FIG. 1, glue G can be provided on the respective attachment panels 131*a*, 131*b* such that when the attachment panels 131*a*, 131*b* are placed atop the containers CA1, CA2, CA3, CB1, CB2, CB3, the attachment panels 131*a*, 131*b* can adhere to top portions of the respective containers CA1, CA2, CA3, CB1, CB2, CB3, e.g., a recessed top portion of the containers. Such adhesion of the containers CA1, CA2, CA3, CB1, CB2, CB3 to the respective attachment panels 131*a*, 131*b* can provide enhanced carrying strength and stability to the carrier 105 by supplementing the engagement of the container-retention portions 135*a*, 135*b* of the respective containers CA1, CA2, CA3, CB1, CB2, CB3 at the respective cuts 141*a*, 141*b* as described above.

Figure 3:
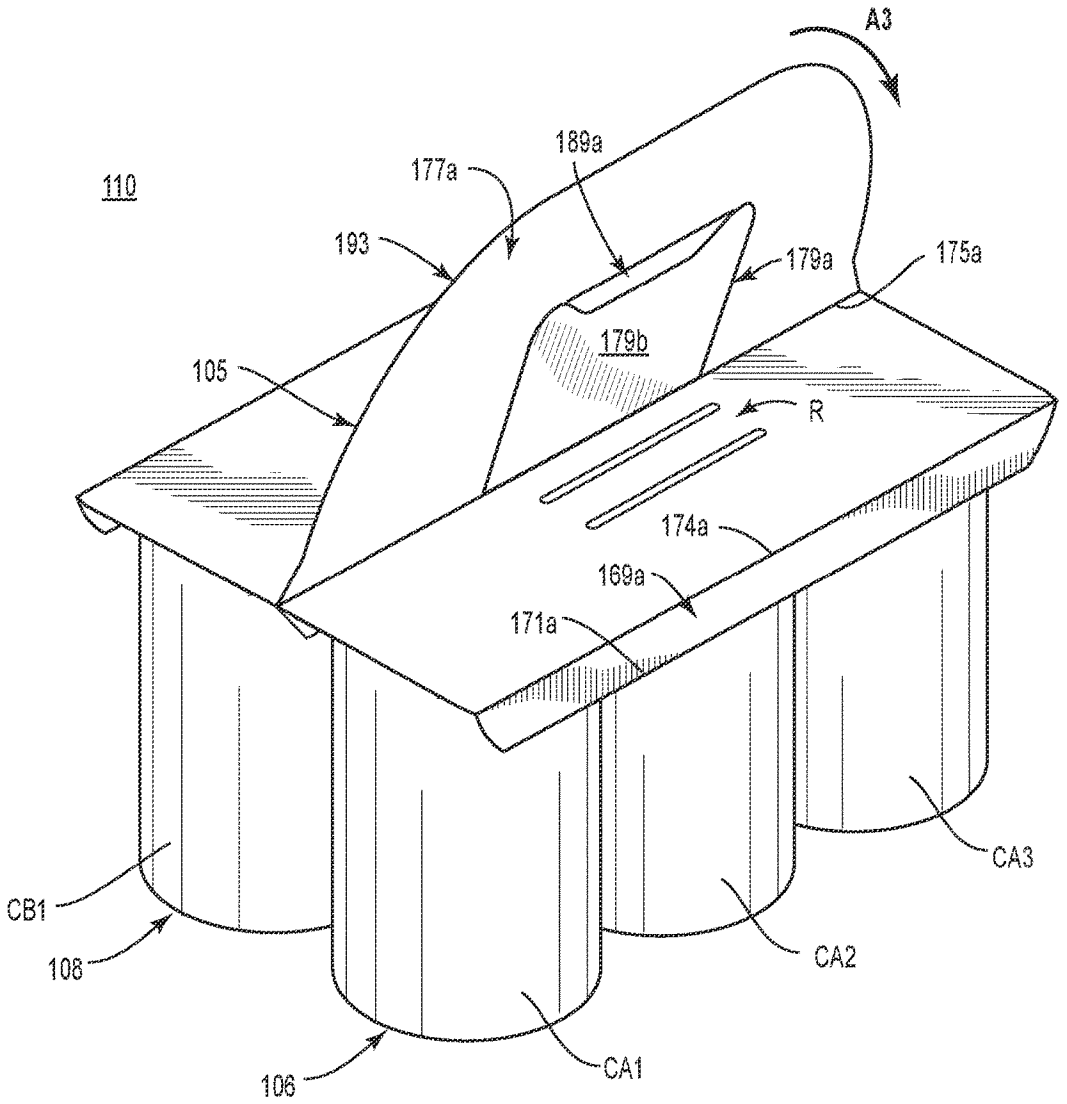
FIG. 3 is another perspective view of a partially folded configuration of the carrier of FIG. 2.

As shown in FIG. 3, and referring additionally to FIG. 4, the region R of adhesive on the front top panel 173*a* is positioned such that when the handle 193 is folded downwardly at the aligned fold lines 175*a*, 175*b* in the direction of the arrow A3, at least a portion of the access flap 179*b* is adhered to the top panel 173*a* through the handle opening 179*a*.

FIG. 4 illustrates a first or shipping/storage configuration of the carrier 105 in which the handle 193 is in a first or shipping/storage position that is generally parallel to the top panels 173*a*, 173*b*. In such an arrangement, the access flap 179*b* is adhered to the region of adhesive R such that a portion of the back handle panel 177*b* is attached to the front top panel 173*a*. Such an arrangement of the handle 193 provides the carrier 105 with a low, e.g., flat, profile such that any protruding structure, edges, extensions, etc. are minimized. In this regard, the shipping configuration of the carrier 105 is a space-saving arrangement of the carrier 105 that can maximize a number of carriers 105 that can be placed in a given shipping or storage space.

Figure 5:
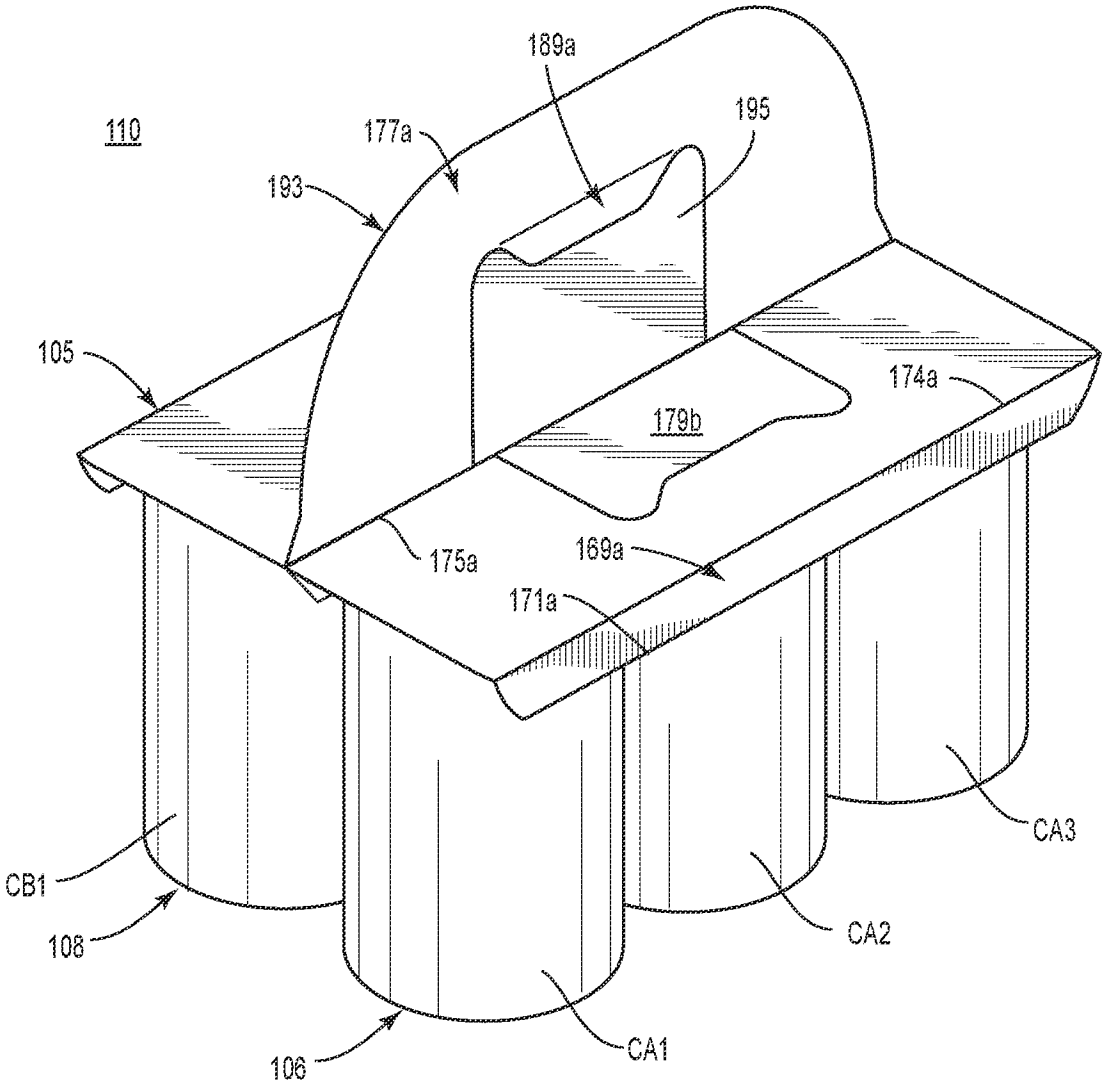
FIG. 5 is a perspective view of the carrier of FIG. 2 with the handle in a second position.

Turning additionally to FIG. 5, upon receipt of the carrier 105 in the shipping configuration by a customer or retailer, the customer can reconfigure the carrier 105 toward a second or carrying configuration for further use. For example, the customer can raise the handle 193 at the aligned fold lines 175*a*, 175*b* in the direction of the arrow A4 such that the handle 193 is provided in a generally upright arrangement (broadly, "first position" or "carrying position") relative to the top panels 173*a*, 173*b*, e.g., such that the handle 193 is disposed in a perpendicular or obliquely-disposed arrangement relative to the top panels 173*a*, 173*b*, for grasping and carrying the carrier.

Such movement of the handle 193 can cause the access flap 179*b* to separate from the handle panel 173*b* and the reinforcement tab 189*b* at respective portions of the cut 181*b*. In this regard, removal of the access flap 179*b* provides a back handle opening 195 that is aligned with the front handle opening 179*a* in the handle panel 173*a* and through which a customer can curl his or her fingers to move, carry, or otherwise engage the carrier 105. During such use, the respective reinforcement tabs 189*a*, 189*b* can at least partially fold at the respective fold lines 191*a*, 191*b* so as to overlap each other as well as the aligned upper portions of the handle panels 177*a*, 177*b*. In this regard, a multi-ply, e.g., four-ply, arrangement of the handle 193 can be provided for robust strength. A pair of carriers 105 in the carrying configuration are illustrated in FIG. 6.

The carrier 105/package 110 described above has a compact structure that can, for example, provide materials savings and waste reduction. Further, the exposure of one or more portions of the containers CA1, CA2, CA3 CB1, CB2, CB3 on exterior portions of the carrier 105/package 110 provides a consumer with a clear view of labeling or surface graphics associated with the containers CA1, CA2, CA3, CB1, CB2, CB3, as well as providing convenient access to remove one or more of the containers CA1, CA2, CA3, CB1, CB2, CB3 from the carrier 105/package 110.

In order to remove a respective container CA1, CA2, CB1, CB2 from the package 110/carrier 105, the top portion T of a respective container can be withdrawn through an opening formed by a respective cut 141*a*, 141*b* along the respective attachment panel 131*a*, 131*b*, and the respective container can be peeled away from the respective attachment panel 131*a*, 131*b*.

It will be understood that the blanks, carriers, and containers described herein can have a different configuration without departing from the disclosure. For example, in one embodiment, one or both of the attachment panels 131*a*, 131*b* can be provided free of adhesive. It will be further understood the arrangement of the handle 193 can be provided with a different package or carrier without departing from the disclosure, for example, the packages/carriers described in U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, U.S. Provisional Patent Application No. 62/841,449, filed on May 1, 2019, U.S. patent application Ser. No. 16/426,050, filed on May 30, 2019, U.S. patent application Ser. No. 16/426,057, filed on May 30, 2019, U.S. patent application Ser. No. 16/426,060, filed on May 30, 2019, U.S. patent application Ser. No. 16/426,063, filed on May 30, 2019, U.S. patent application Ser. No. 16/426,066, filed on May 30, 2019, U.S. Design patent application Ser. No. 29/692,992, filed on May 30, 2019, U.S. Design patent application Ser. No. 29/692,993, filed on May 30, 2019, U.S. Design patent application Ser. No. 29/692,994, filed on May 30, 2019, U.S. Design patent application Ser. No. 29/692,996, filed on May 30, 2019, U.S. Design patent application Ser. No. 29/692,997, filed on May 30, 2019, U.S. patent application Ser. No. 16/598,282, filed on Oct. 10, 2019, U.S. Design patent application Ser. No. 29/709,918, filed on Oct. 18, 2019, U.S. Provisional Patent Application No. 62/952,839, filed on Dec. 23, 2019, U.S. Provisional Patent Application No. 62/956,882, filed on Jan. 3, 2020, U.S. Provisional Patent Application No. 62/985,997, filed on Mar. 6, 2020, U.S. patent application Ser. No. 16/829,346, filed on Mar. 25, 2020, and U.S. Provisional Patent Application No. 63/015,898, filed on Apr. 27, 2020, U.S. Provisional Patent Application No. 63/022,757, filed on May 11, 2020, U.S. Provisional Patent Application No. 63/023,442, filed on May 12, 2020, U.S. Design patent application Ser. No. 29/735,178, filed on May 19, 2020, U.S. Provisional Patent Application No. 63/031,615, filed on May 29, 2020, U.S. Design patent application Ser. No. 29/739,927, filed on Jun. 30, 2020, U.S. Design patent application Ser. No. 29/739,929, filed on Jun. 30, 2020, U.S. Design patent application Ser. No. 29/739,931, filed on Jun. 30, 2020, U.S. Design patent application Ser. No. 29/739,933, filed on Jun. 30, 2020, U.S. Design patent application Ser. No. 29/739,934, filed on Jun. 30, 2020, U.S. Provisional Patent Application No. 63/085,365, filed on Sep. 30, 2020, U.S. Provisional Patent Application No. 63/086,681, filed on Oct. 2, 2020, and U.S. Provisional Patent Application No. 63/120,863, filed on Dec. 3, 2020, U.S. Provisional Patent Application No. 63/136,400, filed on Jan. 12, 2021, the entire contents of which are hereby incorporated by reference in their entireties.

It will be understood that the blanks and carriers described herein can be provided in different configurations without departing from the disclosure.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As described herein, a line of weakening can include one or more of tear lines, cut lines, etc. As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding thereal-ong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, comprising:

a plurality of panels comprising at least one attachment panel configured to receive a portion of one or more containers of the plurality of containers, at least one top panel in at least partial face-to-face contact with the at least one attachment panel, at least one handle panel foldably connected to the at least one top panel, and an access panel separable from the remainder of the at least one handle panel; and a handle formed from the at least one handle panel, the handle is positionable between a first position wherein the at least one handle panel is generally parallel to the at least one top panel and wherein each of the at least one handle panel and the access panel is attached to the at least one top panel, and a second position in which the at least one handle panel is folded relative to the at least one top panel and is positioned for grasping and carrying of the carrier.

2. The carrier of claim 1, wherein in the first position, the access panel is attached to the at least one top panel at a region of adhesive.

3. The carrier of claim 2, wherein the plurality of panels further comprises at least one side panel.

4. The carrier of claim 1, wherein the at least one attachment panel is a back attachment panel, the at least one top panel is a front top panel, and the at least one handle panel is a back handle panel, and the plurality of panels further comprises a front attachment panel configured to receive a portion of one or more containers of the plurality of containers and foldably connected to the front top panel, a back top panel foldably connected to each of the back attachment panel and the back handle panel, and a front handle panel foldably connected to the front top panel, the front handle panel and the back handle panel are in at least partial face-to-face contact.

5. The carrier of claim 2, wherein the back handle panel comprises the access panel such that the access panel is separable from the remainder of the back handle panel.

6. The carrier of claim 5, wherein the access panel is separable from the back top panel at a respective portion of a cut.

7. The carrier of claim 5, wherein, when the handle is in the first position, the access panel is attached to the front top panel at a region of adhesive.

8. The carrier of claim 7, wherein, when the handle is in the second position, the access panel is separated from the remainder of the back handle panel and attached to the front top panel.

9. The carrier of claim 8, wherein the front handle panel comprises a front handle opening, and when the handle is in the second position, a back handle opening is formed by the separation of the access panel from the remainder of the back handle panel, the front handle opening and the back handle opening are aligned.

10. The carrier of claim 9, wherein a handle reinforcement tab is foldably connected to at least one of the front handle panel and the back handle panel.

11. The carrier of claim 9, wherein the plurality of panels further comprises a front side panel foldably connected to each of the front attachment panel and the front top panel, and a back side panel foldably connected to each of the back attachment panel and the back top panel.

12. The carrier of claim 8, wherein each of the front attachment panel and the back attachment panel comprises a plurality of cuts for forming respective openings for receiving a portion of respective containers of the plurality of containers.

13. A blank for forming a carrier for holding a plurality of containers, comprising:

a plurality of panels comprising at least one attachment panel configured to receive a portion of one or more containers of the plurality of containers when the carrier is formed from the blank, at least one top panel in at least partial face-to-face contact with the at least one attachment panel, at least one handle panel foldably connected to the at least one top panel, and an access panel separable from the remainder of the at least one handle panel, the at least one handle panel for forming a handle when the carrier is formed from the blank, the handle for being positionable between a first position wherein the at least one handle panel is generally parallel to the at least one top panel and wherein each of the at least one handle panel and the access panel is attached to the at least one top panel, and a second position in which the at least one handle panel is folded relative to the at least one top panel and is positioned for grasping and carrying of the carrier formed from the blank.

14. The blank of claim 13, wherein the plurality of panels further comprises at least one side panel.

15. The blank of claim 13, wherein the at least one attachment panel is a back attachment panel, the at least one top panel is a front top panel, and the at least one handle panel is a back handle panel, and the plurality of panels further comprises a front attachment panel foldably connected to the front top panel, a back top panel foldably connected to each of the back attachment panel and the back handle panel, and a front handle panel foldably connected to the front top panel, the front handle panel and the back handle panel are for being in at least partial face-to-face contact when the carrier is formed from the blank.

16. The blank of claim 15, wherein the back handle panel comprises the access panel such that the access panel is separable from the remainder of the back handle panel.

17. The blank of claim 16, wherein the access panel is separable from the back top panel at a respective portion of a cut.

18. The blank of claim 16, wherein the plurality of panels further comprises a front side panel foldably connected to each of the front attachment panel and the front top panel, and a back side panel foldably connected to each of the back attachment panel and the back top panel.

19. The blank of claim 16, wherein each of the front attachment panel and the back attachment panel comprises a plurality of cuts for forming respective openings for receiving a portion of respective containers of the plurality of containers when the carrier is formed from the blank.

20. The blank of claim 13, wherein a handle reinforcement tab is foldably connected to at least one of the front handle panel and the back handle panel.

21. A method of forming a carrier for holding a plurality of containers, comprising:

obtaining a blank comprising a plurality of panels including at least one attachment panel, at least one top panel, at least one handle panel foldably connected to the at least one top panel, and an access panel separable from the remainder of the at least one handle panel;

receiving at least one container of the plurality of containers in the at least one attachment panel; and folding the plurality of panels to form the carrier, the folding the plurality of panels comprises positioning the at least one top panel in at least partial face-to-face contact with the at least one attachment panel, the folding the plurality of panels further comprises forming a handle from the at least one handle panel, the handle is positionable between a first position in which the at least one handle panel is generally parallel to the at least one top panel and wherein each of the at least one handle panel and the access panel is attached to the at least one top panel, and a second position in which the at least one handle panel is folded relative to the at least one top panel and is positioned for grasping and carrying of the carrier.

22. The method of claim 21, wherein in the first position, the access panel is attached to the at least one top panel at a region of adhesive.

23. The method of claim 22, wherein the plurality of panels further comprises at least one side panel.

24. The method of claim 21, wherein the at least one attachment panel is a back attachment panel, the at least one top panel is a front top panel, and the at least one handle panel is a back handle panel, and the plurality of panels further comprises a front attachment panel configured to receive a portion of one or more containers of the plurality of containers and foldably connected to the front top panel, a back top panel foldably connected to each of the back attachment panel and the back handle panel, and a front handle panel foldably connected to the front top panel, the front handle panel and the back handle panel are in at least partial face-to-face contact.

25. The method of claim 24, wherein the back handle panel comprises the access panel such that the access panel is separable from the remainder of the back handle panel.

26. The method of claim 25, wherein the access panel is separable from the back top panel at a respective portion of a cut.

27. The method of claim 25, wherein, when the handle is in the first position, the access panel is attached to the front top panel at a region of adhesive.

28. The method of claim 27, wherein, when the handle is in the second position, the access panel is separated from the remainder of the back handle panel and attached to the front top panel.

29. The method of claim 28, wherein the front handle panel comprises a front handle opening, and when the handle is in the second position, a back handle opening is formed by the separation of the access panel from the remainder of the back handle panel, the front handle opening and the back handle opening are aligned.

30. The method of claim 29, wherein a handle reinforcement tab is foldably connected to at least one of the front handle panel and the back handle panel.

31. The method of claim 29, wherein the plurality of panels further comprises a front side panel foldably connected to each of the front attachment panel and the front top panel, and a back side panel foldably connected to each of the back attachment panel and the back top panel.

32. The method of claim 28, wherein each of the front attachment panel and the back attachment panel comprises a plurality of cuts for forming respective openings for receiving a portion of respective containers of the plurality of containers.

33. The method of claim 21, further comprising positioning the handle from the first position to the second position by folding the handle panel relative to the at least one top panel and positioning the handle panel for grasping and carrying of the carrier.

34. A package, comprising:

a plurality of containers; and a carrier holding the plurality of containers, the carrier comprising:

a plurality of panels comprising at least one attachment panel configured receive a portion of respective containers of the plurality of containers, at least one top panel in at least partial face-to-face contact with the at least one attachment panel, at least one handle panel foldably connected to the at least one top panel, and an access panel separable from the remainder of the at least one handle panel; and a handle formed from the at least one handle panel, the handle is positionable between a first position wherein the at least one handle panel is generally parallel to the at least one top panel and wherein each of the at least one handle panel and the access panel is attached to the at least one top panel, and a second position in which the at least one handle panel is folded relative to the at least one top panel and is positioned for grasping and carrying of the carrier.

35. The package of claim 34, wherein in the first position, the access panel is attached to the at least one top panel at a region of adhesive.

36. The package of claim 35, wherein the plurality of panels further comprises at least one side panel.

37. The package of claim 34, wherein the at least one attachment panel is a back attachment panel, the at least one top panel is a front top panel, and the at least one handle panel is a back handle panel, and the plurality of panels further comprises a front attachment panel configured to receive a portion of one or more containers of the plurality of containers and foldably connected to the front top panel, a back top panel foldably connected to each of the back attachment panel and the back handle panel, and a front handle panel foldably connected to the front top panel, the front handle panel and the back handle panel are in at least partial face-to-face contact.

38. The package of claim 37, wherein the back handle panel comprises the access panel such that the access panel is separable from the remainder of the back handle panel.

39. The package of claim 38, wherein the access panel is separable from the back top panel at a respective portion of a cut.

40. The package of claim 38, wherein, when the handle is in the first position, the access panel is attached to the front top panel at a region of adhesive.

41. The package of claim 40, wherein, when the handle is in the second position, the access panel is separated from the remainder of the back handle panel and attached to the front top panel.

42. The package of claim 41, wherein the front handle panel comprises a front handle opening, and when the handle is in the second position, a back handle opening is formed by the separation of the access panel from the remainder of the back handle panel, the front handle opening and the back handle opening are aligned.

43. The package of claim 42, wherein a handle reinforcement tab is foldably connected to at least one of the front handle panel and the back handle panel.

44. The package of claim 42, wherein the plurality of panels further comprises a front side panel foldably connected to each of the front attachment panel and the front top panel, and a back side panel foldably connected to each of the back attachment panel and the back top panel.

45. The package of claim 41, wherein each of the front attachment panel and the back attachment panel comprises a plurality of cuts for forming respective openings for receiving a portion of respective containers of the plurality of containers.

* * * * *